US006161304A

United States Patent [19]

Iaccino et al.

[11] Patent Number: 6,161,304

[45] Date of Patent: Dec. 19, 2000

[54] DRYER ASSEMBLY

[75] Inventors: Lawrence A. Iaccino, Mount Prospect; Jozef Wisniewski, Chicago, both of Ill.

[73] Assignee: M&R Printing Equipment, Inc., Glen Ellyn, Ill.

[21] Appl. No.: 09/412,118

[22] Filed: Oct. 5, 1999

[51] Int. Cl.[7] ..... F26B 19/00

[52] U.S. Cl. ..... 34/208; 34/210; 34/229; 34/231

[58] Field of Search ..... 34/201, 208, 210, 34/215, 216, 217, 229, 231

[56] References Cited

U.S. PATENT DOCUMENTS

| | | | |
|---|---|---|---|
| 3,928,703 | 12/1975 | Cook | 428/255 |
| 4,086,393 | 4/1978 | Hart | 428/51 |
| 4,192,751 | 3/1980 | Henton et al. | 210/136 |
| 4,491,610 | 1/1985 | Mansour | 34/217 |
| 4,495,021 | 1/1985 | Goldsworthy | 156/425 |
| 4,498,941 | 2/1985 | Goldsworthy | 156/148 |
| 4,520,750 | 6/1985 | Mansour | 34/217 |
| 4,567,673 | 2/1986 | Bohnensieker | 34/217 |
| 5,023,429 | 6/1991 | Bailey et al. | 34/203 |
| 5,144,108 | 9/1992 | Passarotto | 34/179 |
| 5,447,003 | 9/1995 | Warren et al. | 34/201 |
| 5,634,281 | 6/1997 | Nugent | 34/217 |
| 5,651,191 | 7/1997 | Walunas et al. | 34/216 |
| 5,655,312 | 8/1997 | Sevcik | 34/275 |
| 5,908,000 | 6/1999 | Spychalla et al. . | |
| 5,937,535 | 8/1999 | Hoffman, Jr. et al. . | |

*Primary Examiner*—Stephen Gravini
*Assistant Examiner*—Andrea M. Joyce
*Attorney, Agent, or Firm*—Wallenstein & Wagner, Ltd.

[57] ABSTRACT

A dryer for curing articles with printings thereon is disclosed. The system includes an exterior housing, an interior lining defining a drying chamber within the exterior housing, means for heating an article within the drying chamber, and a surface for supporting the article within the drying chamber. The dryer housing preferably includes an entrance opening and an exit opening to allow articles to pass through the drying chamber. The dryer may include a conveyor system for automatically moving the articles from the entrance to the exit. The means for heating the articles or directing heated air onto the articles is preferably adjustable in a vertical direction, while the interior lining is made from a non-conductive material, such as fiberglass or a fiberglass cloth. An air duct carrying air into the drying chamber is connected at the one end of the lining, preferably on the dryer's top wall, while a return air duct is preferably connected to a separate bottom wall panel of the drying chamber. The upper air ducts are adapted to pass air from a blower into an air plenum where the air is forced downward onto the article passing through the drying chamber. The lower air duct returns the air to a low pressure inlet of the blower to be recycled. The drying chamber is preferably suspended within the exterior housing and made from a closed-mesh material. This prevents the escape of much heated air from the drying chamber.

27 Claims, 3 Drawing Sheets

DRYER ASSEMBLY

DESCRIPTION

1. Technical Field

The present invention relates generally to an assembly for curing inked textiles and substrates and, more particularly, to a novel dryer utilizing a non-conductive material to provide an interior lining to reduce the amount of heat conducted to the outer housing of the dryer. This reduction helps improve efficiency by retaining heat within the dryer.

2. Background Prior Art

Indicia applied permanently to articles of clothing and other textiles have become very popular. Fanciful indicia, such as logos, slogans, college names, sports team names and sayings, are now commonplace. As a result, screen printing has become very popular. Large, commercial operations for screen printing textiles are common today. Indicia on a textile or substrate (e.g., for transfers), herein referred to collectively as articles, can be one or more colors. Typically, a screen printing machine has at least one station for each color employed. For example, a design incorporating two colors will have at least two printing stations, one for each color. A design employing eight colors will have at least eight stations. Each station generally includes a printing head, which supports a single screen, the ink that is used at that station and a mechanism for applying the ink to the article. Each color is carried by a single screen. The article to be screened travels from printing station to printing station by one of a number of methods, such as a chain or a rigid arm. The article is usually carried by a metal pallet, pallet support, flat bed, or platen. Common printing machines include turret, oval and linear.

Some printing machines incorporate curing stations therein. Other operations employ separate dryers. A dryer has two primary components, a conveyor system and a heating system. At present, the drying of an article with printing thereon is performed by the operator first setting the temperature inside the dryer, then setting the speed of the conveyor system. Commonly known mechanisms may be employed to determine/read the ambient temperature somewhere in the dryer, permitting the operator to adjust the conveyor speed to compensate for temperatures too high or too low.

Numerous inks are available in the industry from many different producers. Such inks include water base, sublimation and plastisol. The ink is cured or gelled on the article to a critical temperature. The temperature during the curing process must be kept within a window suitable for the ink-curing conditions, typically between 125° F. to 450° F. Unfortunately, with some inks and/or articles, temperatures are crucial. The quality and lifetime of a product may be negatively affected by incorrect temperatures. For example, with plastisols, the temperature must reach 320° F.; the time for this heating can be less relevant. However, in a range (below 320° F. or above 350° F.), the plastisol will not properly set, resulting in cracking, or it may become liquified. For example, if the temperature is too low, the plastisol will not cure properly, and will not adhere to the article; if the temperature exceeds 350° F., the plastisol will over-gel. Similarly, if a dye in the article is overheated, it will migrate. And, the article may scorch or burn, thereby ruining the product and increasing waste and production costs.

Prior art dryers are typically large units having an outer metal housing shell. The shell may be filled with an insulative material, such as fiberglass. Within the dryer the necessary heat may be either generated by an integral heating system, ducted in by a stream of air from an external heat source, or a combination of the two methods. In any event, despite the insulated shell, much of the heat within the dryer is conducted through the metal housing and radiated to the work environment. This lowers the efficiency of the dryer, and creates a unpleasant work environment.

As a result, there is a need to minimize the conduction of heat through the metal housing, and seal heat within the dryer to improve efficiency. In an effort to fulfill these needs and to continuously improve upon the screening/printing process and machines available in the marketplace, the following advancements and improvements have been developed to the apparatus and method of drying articles once they have been inked and printed upon.

SUMMARY OF THE INVENTION

According to a first aspect of the present invention, an apparatus and method are disclosed for drying articles. A dryer for curing articles with printings thereon is disclosed. The system includes, generally, an exterior housing, an interior lining defining a drying chamber within the exterior housing, means for heating an article within the drying chamber, and a surface for supporting the article within the drying chamber.

In particular, the dryer housing preferably includes an entrance opening and an exit opening to allow articles to pass through the drying chamber. The dryer may include a conveyor system for automatically moving the articles from the entrance to the exit. The means for heating the articles or directing heated air onto the articles is preferably adjustable in a vertical direction, while the interior lining is made from a non-conductive material, such as woven fiberglass cloth.

An air duct carrying air into the drying chamber is connected at the one end of the lining, preferably on the dryer's top wall. A second air duct may also be connected at the same end of the top wall. These air ducts are preferably spaced apart. A return air duct is preferably connected to a separate bottom wall panel of the drying chamber. The upper air ducts are adapted to pass air from a blower, into an air plenum or grate where the air is forced downward onto the article passing through the drying chamber. It is an aspect of one embodiment of the present invention to heat the forced air before it contacts the printed articles. The lower air duct returns the air to a low pressure inlet of the blower to be recycled.

In addition, the drying chamber formed of a woven fiberglass cloth, or blanket, is preferably suspended within the exterior housing. Minimal contact between the drying chamber and the housing reduces the conduction of heat to the outer surface of the dryer. It is a further aspect of the invention to use a non-porous material for the interior lining. This prevents the escape of much heated air from the drying chamber.

Other advantages and aspects of the present invention will become apparent upon reading the following description of the drawings and the detailed description of the invention.

BRIEF DESCRIPTION OF DRAWINGS

To understand the present invention, it will now be described by way of example, with reference to the accompanying drawings in which.

DETAILED DESCRIPTION

While the invention is susceptible of embodiment in many different forms, this disclosure describes, in detail, preferred embodiments of the invention with the understanding the present disclosure is to be considered as an exemplification of the principles of the invention and is not intended to limit the broad aspects of the invention to the embodiments illustrated.

Referring generally to the appended FIGS. 1–9, the process of drying an article after screen printing using the present invention can be more readily understood. The disclosed dryer assembly is generally referenced by the number "10" in the following disclosure and drawings. Other components are similarly and consistently numbered throughout the specification and drawings.

Figure 1:
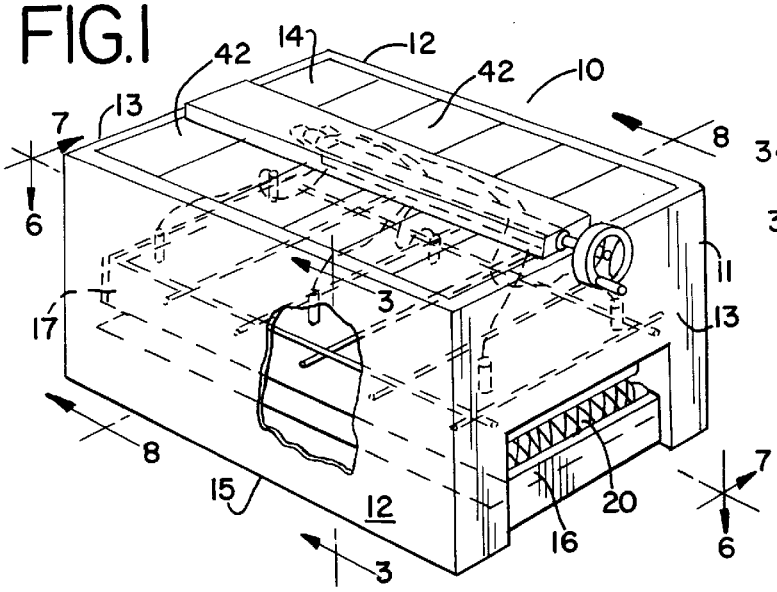
FIG. 1 is a side perspective view of one embodiment of a dryer assembly made in accordance with the teachings of the present invention.

Turning to FIG. 1, a dryer assembly 10 is shown. The assembly includes an exterior housing 11 wherein the articles passing therethrough are heated. The housing 11 is formed of opposed side walls 12, opposed end walls 13, a top wall 14 comprised of several removable panels 42 and a bottom wall 15. Such walls and panels are generally constructed of sheet metal with a double wall construction surrounding a layer of insulative material to assist in keeping the outer walls relatively cool. At one end of the housing 11 there is an entrance opening 16 and at the other end there is an exit opening 17.

Figure 3:
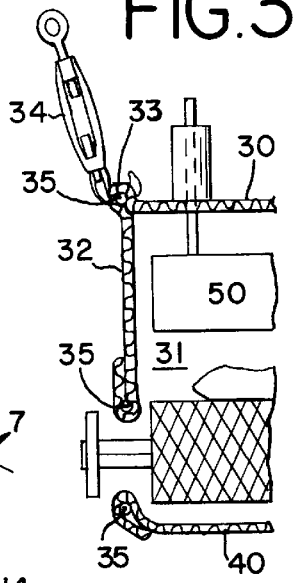
FIG. 3 is a fragmentary side elevation view of the interior of the dryer taken along line 3—3 in FIG. 1.
Figure 2:
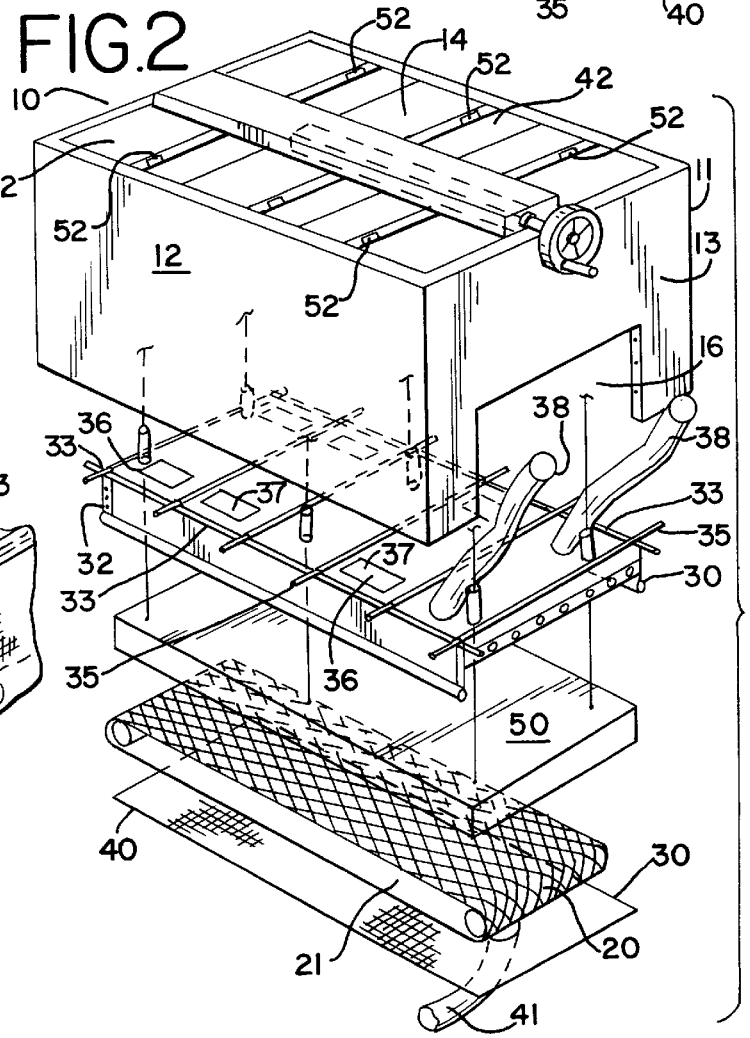
FIG. 2 is an exploded perspective view of the embodiment of a dryer assembly shown in FIG. 1.

Within the exterior housing 11 is preferably suspended an interior lining 30 defining a drying chamber 31 (FIG. 3). The interior lining 30 is shown in FIG. 2 as two separate sections. The first section 32 is preferably a tent-like configuration creating three sides—i.e., top, left and right sides—of the drying chamber 31. The interior lining 30 may be approximately the length and width of the exterior housing 11, but is preferably significantly shorter and narrower (see FIG. 6) to create an insulative layer of air between the drying chamber 31 and the exterior housing 11.

Figure 4:
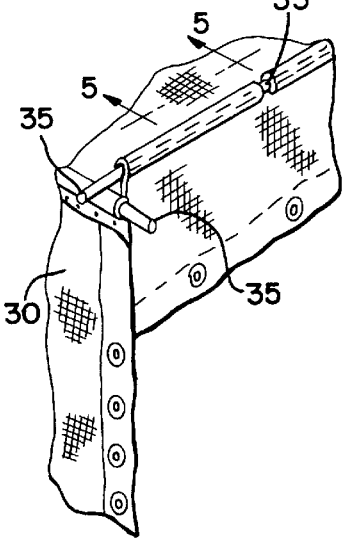
FIG. 4 is a perspective fragmentary view of seemed edges of the interior lining of one embodiment of the dryer assembly.
Figure 6:
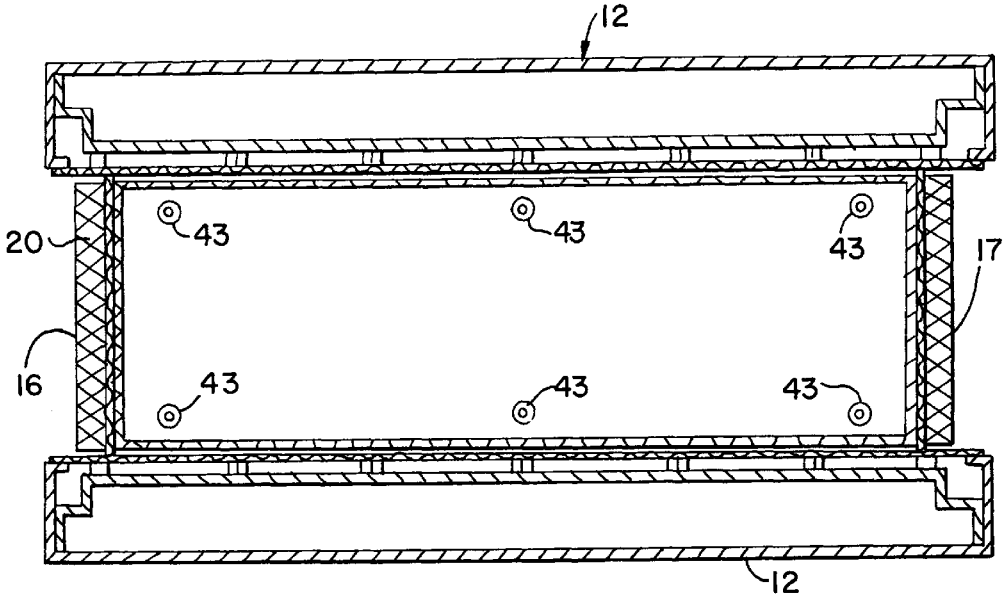
FIG. 6 is a top plan view of a cross-section of the embodiment shown in FIG. 1 taken along plane 6—6 in FIG. 1.

The narrower and shorter first section 32 of interior lining 30 is suspended at multiple points 33 along its length and width to an interior point of the exterior housing 11. FIG. 3 illustrates one possible suspension configuration using an adjustable turnbuckle 34 fastened to a metal rod 35 inserted into a seam of the interior lining 30, as best seen in FIG. 4, at each suspension point 33—six along each side of the interior housing 30 as shown in FIG. 2. Tension springs, metal cable, metal rods and the like may also work adequately as the needed suspending mechanisms. The opposite end of turnbuckle 34 is fastened to an interior point of the exterior housing 11. The tumbuckles 34 may be turned to adjust the tension of the suspended interior lining 30. The suspension of interior lining 30 helps prevent the conduction of heat from within the drying chamber 31 to the exterior housing 11, due to the minimal amount of direct contact with the exterior housing 11.

Figure 5:
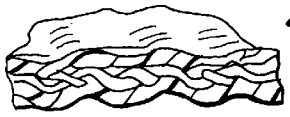
FIG. 5 is an elevation fragmentary view of a cross-section of the lining material taken along line 5—5 in FIG. 4.

The interior lining 30 itself is preferably a fiberglass material, or fiberglass cloth, sealed on both surfaces with a poly(tetrafluoroethylene) layer, known more commonly in the industry as TEFLON®. Such material is manufactured by Advanced Flexible Composites, Inc., of Lake-in-the-Hills, Ill. The fiberglass material providing the best results, shown in FIG. 5, is known in the industry as "closed-mesh." This "closed-mesh" material allows the heat within the drying chamber 31 to be retained within the chamber for longer time periods, improving the efficiency of the dryer 10.

Access ports 36 may be provided within the top panel of the first section 32. The ports 36 permit access to the interior of the drying chamber 31 for inspection, maintenance, or observation of the drying operation. Preferably, the access ports 36 are provided with oversized flaps 37 of fiberglass material which fasten to the periphery of the ports 36 using a hook-and-loop, e.g., metal and/or nomax, or similar type of material. The ports 36 are accessible by first removing the removable panels 42 of the exterior housing 11. At least one air duct 38 may also be provided within the top panel of first section 32 (two air ducts 38 are shown in FIG. 2). These air ducts 38 are used to direct air into the drying chamber 31, as explained later in this disclosure.

Figure 8:
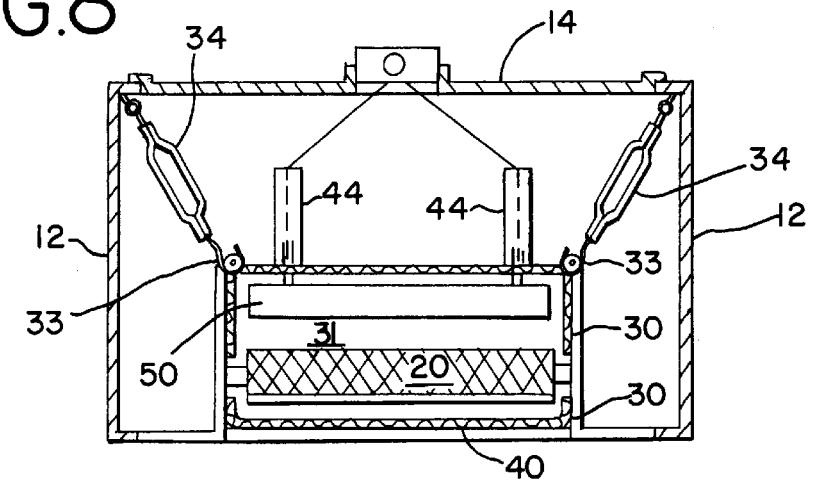
FIG. 8 is a front elevation view of a cross-section of the embodiment shown in FIG. 1 taken along plane 8—8 in FIG. 1; and, FIG. 9 is a perspective view of an air plenum for use in the present invention.

The bottom of the drying chamber 31 is comprised of a second section 40 of the interior lining 30. The second section 40 is also preferably made from the same coated fiberglass cloth material, and suspended in a similar manner as discussed previously from the interior of the exterior housing 11. The second section 40 should be suspended at a position proximate to the bottom edge of the left and right side walls 12 of the first section 32, as shown in FIG. 8. The second section 40 is provided as a separate panel to simplify installation of the interior lining 30 into the exterior housing 11. A return air duct 41 is attached to the second section 40, and directs air out of the drying chamber 31, as will be explained below.

Figure 7:
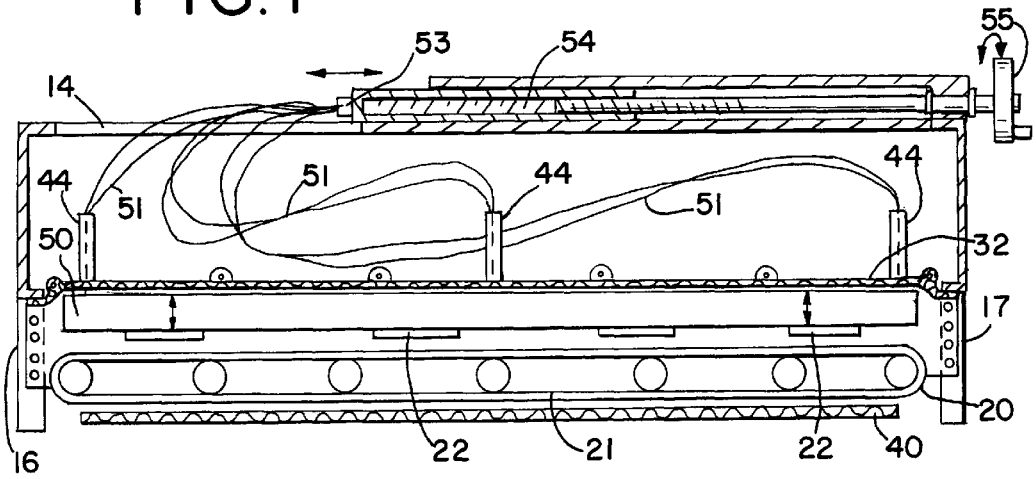
FIG. 7 is a side elevation view of a cross-section of the embodiment shown in FIG. 1 taken along plane 7—7 in FIG. 1.
Figure 9:
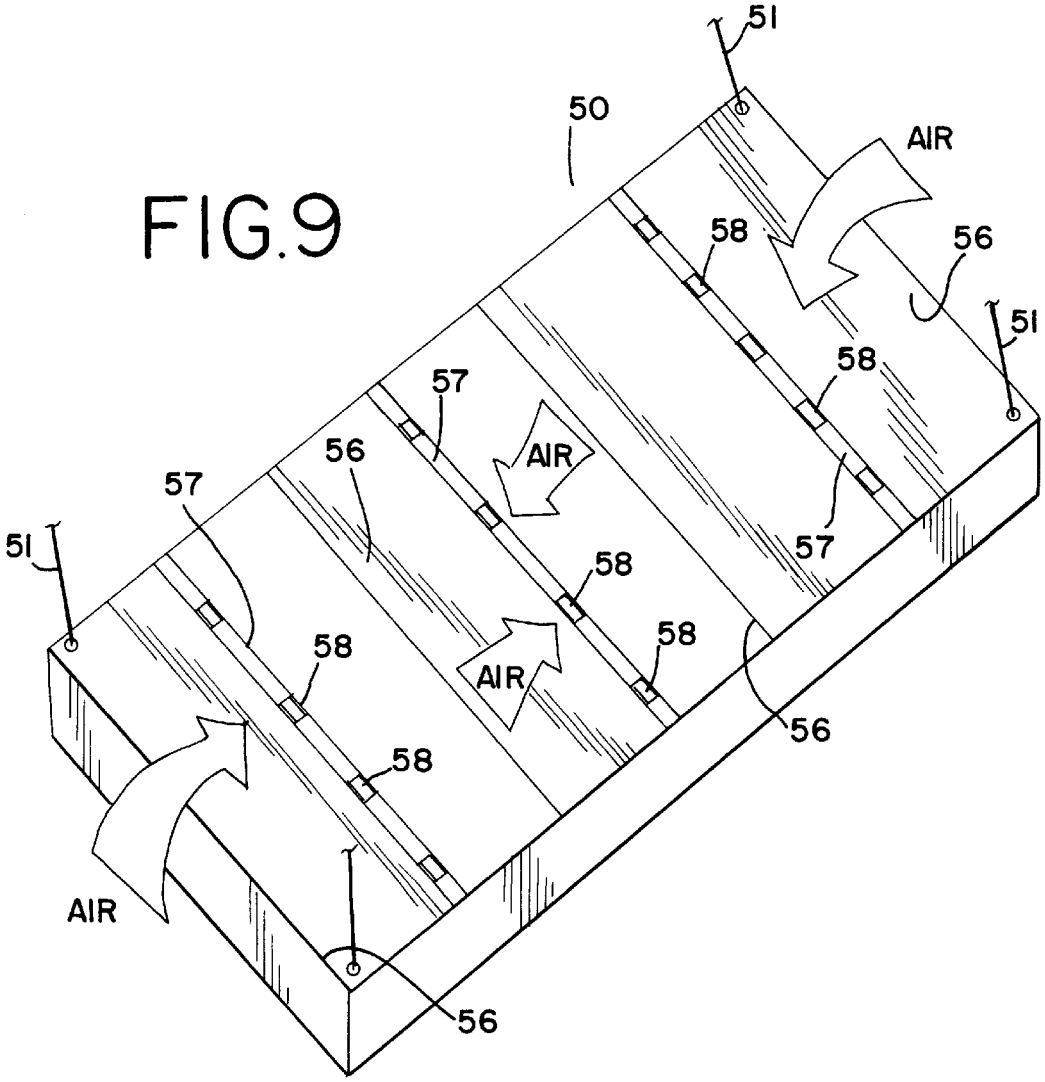

Within the drying chamber, a conveyor system 20 and an air plenum 50 are shown in FIGS. 7 through 9. The conveyor system 20—shown as a continuous belt 21 having a highly porous (or open mesh) surface area, such as a screen, mounted on at least two rollers—is driven by a motor (not shown) and passes through the drying chamber 31 between the side wall 12 of housing 11, first section 32 of the interior lining 30, and second section 40 of the interior lining 30, from the entrance opening 16 to the exit opening 17. The continuous belt 21 of the conveyor system 20 should be of sufficient width to carry large or oversized articles such as sweatshirts, nightshirts, and the like. The length of belt 21 is obviously dictated by the size of dryer 10, but this length must be taken into consideration when setting the speed of travel through housing 11. That is, a sufficient residence time within the dryer 10 must be allowed for each printed article. The conveyors may extend beyond the openings to points outside the housing.

The air plenum 50, a preferred embodiment being illustrated in FIG. 9, is basically a metal grate for directing air, particularly heated air, onto the printed articles. The air plenum 50 is suspended via six metal suspension wires 51 attached to the air plenum 50 and passing upward to the top of exterior housing 11. FIGS. 7 and 8 illustrate the passing of the wires 51 through grommet holes 43 (FIG. 6) affixed in the top panel of the interior lining 30. Sealing tubes 44 are attached about each grommet hole 43 to prevent the escape of heated air from the drying chamber 31.

Referring to FIGS. 2 and 8, the adjustability of the distance between the air plenum 50 and conveyor 20 is illustrated by arrows. The adjustability of the air plenum 50 is necessary to accommodate various thicknesses of articles—for example, sweatshirts vs. tee-shirts. The suspension wires 51, or similar material capable of supporting the weight of the air plenum 50, are passed through guide holes 52 in supports extending across the top of the exterior housing 11. The free end of each wire 51 is then attached to a movable threaded block 53 (FIG. 7) which is capable of movement via attachment to a threaded shaft 54 (see arrows of FIG. 7). As the shaft 54 is turned manually in one direction, by the handle 55 as illustrated in FIG. 7, the block 53 moves up the shaft 54—much like a nut does when engaged with a turning bolt—pulling with it the wires 51. As the wires are pulled along, the air plenum 50 is simultaneously raised. Turning the handle 55 and shaft 54 in the opposite direction moves the block 53 down the shaft 54, simultaneously lowering the air plenum 50. Those skilled in the art understand this is merely an exemplary mechanism for adjusting the air plenum 50, and other mechanisms are certainly possible without departing from the intended spirit of the present invention.

The plenum 50 is comprised of several hills 56 and valleys 57, with slotted openings 58 disposed in each of the valleys 57. The air entering the drying chamber 31 from air ducts 38 is directed by the hills 56 into the adjacent valleys 57, and through the slots 58 where it is discharged in the direction of the conveyor 20. Many different configurations are possible for the air plenum 50 by varying the number of hills 56, valleys 57, or slots 58. These varied configurations are also considered to fall within the intended spirit and scope of the present invention.

A conventional air blower (not shown) having an air outlet (high pressure) side and an air inlet (low pressure) side may be positioned within or adjacent the exterior housing 11. The air ducts 38 are connected to the outlet (high pressure) side of the air blower and direct the air from the blower into the drying chamber 31 and onto one surface of the air plenum 50. Air duct 41 is connected to the air inlet (low pressure) side of the air blower and recycles the air used to cure the articles.

Heating elements, shown schematically at reference number 22, are within (generally above or below the air plenum 50) or immediately adjacent the dryer housing 11 within the air ducts 38 (not shown). Heating elements 22 positioned within the housing 11 may be any conventional type heater known to those skilled in the art, such as electric resistance heaters, infrared heaters, flash lamps, or the like. These heating elements 22 heat the incoming air before it reaches the article, but also, generally, heat the drying chamber to a temperature range of from about 200° F. to about 600° F. Heaters positioned outside of and adjacent to the housing 11 would be used to heat an air supply which is then conducted into the drying chamber 31 to achieve the desired temperature.

The return air duct 41 located below the conveyor 20 directs the air passing through the housing 11 and conveyor 20 to the air inlet side of the blower to be discharged back into the dryer 10, thereby re-circulating the heated air and increasing the assembly's efficiency. Alternatively, the air may be released from the drying chamber 31 via air duct 41 to the surrounding atmosphere.

The operation of the dryer assembly 10 is similar to that of the dryer disclosed in U.S. Pat. No. 5,937,535, issued Aug. 17, 1999, and assigned to M&R Printing Equipment, Inc. of Glen Ellyn, the assignee of the present invention. To the extent the '535 patent disclosure is consistent with the goals of the present invention it is hereby incorporated by reference.

As an added benefit for some systems, as described in the incorporated reference, a means to detect the temperature inside the housing may be included. Such means include industrial grade thermometers that measure the ambient air within the housing. This information can be fed to a control panel (not shown) and displayed to assist an operator in deciding whether to manually adjust the conveyor's speed, the heat applied, and/or the air movement created by the blower. Conventional means for automatically adjusting these elements may also be used.

While the specific embodiments have been illustrated and described, numerous modifications are possible without significantly departing from the spirit of the invention and the scope of protection is only limited by the scope of the accompanying Claims.

We claim:

1. A dryer for curing articles comprising:

an exterior housing having an entrance opening and an exit opening;

an interior lining defining a drying chamber within the exterior housing, the interior lining being made of a non-heat conducting material and separated from the exterior housing by a thickness of air;

means for heating an article within the drying chamber; and, a surface for supporting an article within the drying chamber.

2. The dryer as described in claim 1 wherein the non-heat conducting material of the interior lining is a coated fiberglass material.

3. The dryer as described in claim 2 wherein the fiberglass material is a fiberglass cloth coated on at least one side with poly(tetrafluoroethylene).

4. The dryer as described in claim 2 wherein the fiberglass material is a fiberglass cloth coated on both sides with poly(tetrafluoroethylene).

5. The dryer as described in claim 1 wherein the means for heating an article comprises at least one of an electric heater and gas heater.

6. The dryer as described in claim 1 wherein the means for heating an article comprises a plurality of at least one of electric heaters and gas heaters.

7. The dryer as described in claim 1 further comprising a conveyor system for moving an article through the drying chamber from the entrance opening to the exit opening of the exterior housing.

8. The dryer as described in claim 1 wherein the means for heating comprises a stream of heated air.

9. The dryer as described in claim 8 wherein the interior lining comprises an inlet for directing the heated air into the dryer.

10. The dryer as described in claim 5 wherein the means for heating comprises a stream of heated air.

11. The dryer as described in claim 6 wherein the means for heating comprises a stream of heated air.

12. The dryer as described in claim 8 further comprising a grate for directing the stream of heated air onto the article.

13. The dryer as described in claim 12 wherein the grate is suspended a distance above the article from the exterior housing of the dryer.

14. The dryer as described in claim 13 wherein the distance is adjustable.

15. The dryer as described in claim 1 further comprising an insulator between the interior lining and the exterior housing.

16. The dryer as described in claim 15 wherein the insulator is air.

17. The dryer as described in claim 1 wherein the interior lining comprises:

a first section forming the majority of three sides of the interior lining; and a second section forming the majority of a fourth side of the interior lining.

18. The dryer as described in claim 17 wherein the non-heat conducting material is a coated fiberglass material.

19. The dryer as described in claim 18 wherein the fiberglass material is a fiberglass cloth coated on at least one side with poly(tetrafluoroethylene).

20. The dryer as described in claim 18 wherein the fiberglass material is a fiberglass cloth coated on both sides with poly(tetrafluoroethylene).

21. The dryer as described in claim 17 the interior lining further comprises at least one access bay.

22. The dryer as described in claim 21 wherein the at least one access bay is provided in the primary section of the interior lining.

23. A dryer for curing an article comprising:

an exterior housing having an entrance opening and an exit opening;

an interior lining suspended within the exterior housing to define at least three sides of a drying chamber, the interior lining being a non-heat conducting material;

an insulation layer between the interior lining and the exterior housing;

a surface for supporting an article within the drying chamber;

a heater within the exterior housing and directed toward the surface;

a conveyor system for moving an article along the surface through the dryer from the entrance opening to the exit opening.

24. The dryer as described in claim 23 wherein the non-heat conducting material of the interior lining is a coated fiberglass material.

25. The dryer as described in claim 24 wherein the fiberglass material is a fiberglass cloth coated on at least one side with poly(tetrafluoroethylene).

26. The dryer as described in claim 24 wherein the fiberglass material is a fiberglass cloth coated on both sides with poly(tetrafluoroethylene).

27. The dryer as described in claim 23 wherein the means for heating comprises a stream of heated air.

* * * * *